US011542855B1

(12) United States Patent
Park et al.

(10) Patent No.: US 11,542,855 B1
(45) Date of Patent: Jan. 3, 2023

(54) PCJ SOLENOID VALVE DIAGNOSTIC METHOD

(71) Applicants: Hyundai Motor Company, Seoul (KR); Kia Corporation, Seoul (KR)

(72) Inventors: Tae Won Park, Incheon (KR); Duk Jin Park, Seoul (KR)

(73) Assignees: Hyundai Motor Company, Seoul (KR); Kia Corporation, Seoul (KR)

( * ) Notice: Subject to any disclaimer, the term of this patent is extended or adjusted under 35 U.S.C. 154(b) by 0 days.

(21) Appl. No.: 17/739,611

(22) Filed: May 9, 2022

(30) Foreign Application Priority Data

Aug. 6, 2021 (KR) ..... 10-2021-0103881

(51) Int. Cl.

| | |
|---|---|
| ***F01P 11/14*** | (2006.01) |
| ***F01P 3/08*** | (2006.01) |
| ***F01P 7/14*** | (2006.01) |
| *F01P 3/00* | (2006.01) |

(52) U.S. Cl.
CPC ..... *F01P 11/14* (2013.01); *F01P 3/08* (2013.01); *F01P 7/14* (2013.01); *F01P 2003/006* (2013.01); *F01P 2007/146* (2013.01); *F01P 2025/04* (2013.01); *F01P 2025/40* (2013.01); *F01P 2025/64* (2013.01)

(58) Field of Classification Search
CPC ..... F01P 11/14; F01P 3/08; F01P 2007/147; F01P 2025/04
See application file for complete search history.

(56) References Cited

U.S. PATENT DOCUMENTS

| | | | | |
|---|---|---|---|---|
| 2011/0283968 | A1* | 11/2011 | Anderson | F01M 1/08 123/196 R |
| 2015/0027388 | A1* | 1/2015 | Honda | F01M 1/08 123/41.35 |
| 2016/0186642 | A1* | 6/2016 | Honda | F01P 3/08 123/41.35 |
| 2016/0230640 | A1* | 8/2016 | Kamimura | F02F 1/14 |
| 2019/0078493 | A1* | 3/2019 | Kim | F02F 3/16 |
| 2019/0195735 | A1* | 6/2019 | Han | G01M 15/09 |

FOREIGN PATENT DOCUMENTS

| | | |
|---|---|---|
| KR | 10-1461901 | 11/2014 |

* cited by examiner

*Primary Examiner* — Long T Tran
(74) *Attorney, Agent, or Firm* — Morgan, Lewis & Bockius LLP

(57) ABSTRACT

A method of diagnosing a PCJ solenoid valve includes determining whether a predetermined diagnostic condition is satisfied; performing diagnostic spraying by controlling the PCJ solenoid valve to cause the PCJ to spray oil for a predetermined diagnostic spraying time when the controller concludes that the predetermined diagnostic condition is satisfied; and diagnosing a failure of the PCJ solenoid valve by use of changes of oil pressure introduced to the PCJ or of PWM duty that controls an oil pump configured for pumping oil supplied to the PCJ after the diagnostic spraying from the PCJ.

20 Claims, 4 Drawing Sheets

PCJ SOLENOID VALVE DIAGNOSTIC METHOD

CROSS REFERENCE TO RELATED APPLICATION

The present application claims priority to Korean Patent Application No. 10-2021-0103881, filed Aug. 6, 2021, the entire contents of which is incorporated herein for all purposes by this reference.

BACKGROUND OF THE PRESENT DISCLOSURE

Field of the Present Disclosure

The present disclosure relates to a technique of diagnosing a piston cooling jet (PCJ) solenoid valve.

Description of Related Art

A piston of an engine serves to convert the explosion energy of a fuel generated in a combustion chamber into mechanical power and may reciprocate at a high speed while forming a portion of the combustion chamber, to which proper cooling and lubrication are indispensable.

The cooling and lubrication of the piston are mainly performed by an engine oil (hereinafter simply referred to as 'oil'), and a piston cooling jet (PCJ) spraying oil to the underside of the piston can very effectively cool or lubricate the piston.

However, the engine is in a variety of operating states like a start-up state, a high load state, a high rotation state, and the like, and thus, requires different cooling performances suited for the various operating states.

Accordingly, simply spraying oil toward the piston with the PCJ is insufficient and a solenoid valve controlling oil supply to the PCJ may be required to precisely control the oil sprayed by the PCJ.

The PCJ solenoid valve as described above is a target of the on-board diagnostics (OBD) and the diagnosis is conventionally made by use of an oil pressure switch (OPS) switched on or off by the oil pressure introduced to the PCJ solenoid valve. However, the OPS increases the manufacturing cost of the engine system and is difficult to install when mounting space is not readily secured.

The information included in this Background of the present disclosure section is only for enhancement of understanding of the general background of the present disclosure and may not be taken as an acknowledgement or any form of suggestion that this information forms the prior art already known to a person skilled in the art.

BRIEF SUMMARY

Various aspects of the present disclosure are directed to providing a PCJ solenoid valve diagnostic method of facilitating a diagnosis of a failure of the PCJ solenoid valve without using an OPS, facilitating the diagnosis of the failure of the PCJ solenoid valve even when a mounting space for the OPS is not readily secured and reducing the manufacturing cost of the engine system.

The method of diagnosing the PCJ solenoid valve according to an exemplary embodiment of the present disclosure includes determining, by a controller, whether a predetermined diagnostic condition is satisfied; performing, by the controller, diagnostic spraying by controlling the PCJ solenoid valve to cause the PCJ to spray oil for a predetermined diagnostic spraying time when the controller concludes that the predetermined diagnostic condition is satisfied; and diagnosing, by the controller, a failure of the PCJ solenoid valve by use of changes of oil pressure introduced to the PCJ or of a pulse-width modulation (PWM) duty that controls an oil pump configured for pumping oil supplied to the PCJ after the diagnostic spraying by the PCJ.

The diagnostic conditions may include a situation where the coolant temperature is equal to or greater than a predetermined reference coolant temperature; the oil temperature is equal to or lower than a predetermined reference oil temperature; and the PCJ is not spraying the oil.

The diagnostic conditions may be either an engine revolutions per minute (RPM) continuously increasing without deceleration from an idle RPM up to a predetermined increase limit RPM or the engine RPM reaching a predetermined decrease limit RPM by a tip-out from a predetermined decrease start RPM or more than the predetermined decrease start RPM.

The diagnosing a failure of the PCJ solenoid valve may include determining whether the oil pressure introduced to the PCJ decreases by a predetermined reference pressure or more after the diagnostic spraying by the PCJ; and determining that the PCJ solenoid valve has failed when a situation where the oil pressure does not decrease by the predetermined reference pressure or more than the predetermined reference pressure repeats itself a predetermined reference number of times or more than the predetermined reference number of times.

When the oil pressure decreases by the predetermined reference pressure or more, a counter for comparison with the reference number of repetitions may be reset.

The diagnosing a failure of the PCJ solenoid valve may include determining whether the PWM duty that controls the oil pump pumping the oil supplied to the PCJ deviates from a predetermined average duty by a predetermined reference duty or more the predetermined reference duty after the diagnostic spraying by the PCJ; and determining that the PCJ solenoid valve has failed when a situation where the PWM duty deviates from the predetermined average duty by the predetermined reference duty or more the predetermined reference duty repeats itself a predetermined reference number of times or more than the predetermined reference number of times.

When the PWM duty does not deviate from the predetermined average duty by the predetermined reference duty or more, the counter for comparison with the reference number of repetitions may be reset.

The predetermined average duty may be determined without performing further steps beyond determining whether the PWM duty deviates from the predetermined average duty by the predetermined reference duty or more in a driving cycle, equal to or less than a predetermined reference driving cycle, for determining the average duty.

When the PWM duty does not deviate from the predetermined average duty by the predetermined reference duty or more, the predetermined average duty may be updated with an average of the PWM duties, including the PWM duty, of driving cycles corresponding to the predetermined reference driving cycle.

The diagnosing a failure of the PCJ solenoid valve may include determining whether the oil pressure introduced to the PCJ decreases by a predetermined reference pressure or more after the diagnostic spraying by the PCJ; determining whether the PWM duty that controls the oil pump pumping the oil supplied to the PCJ deviates from the predetermined average duty by a predetermined reference duty or more the predetermined reference duty after the diagnostic spraying by the PCJ; and determining that the PCJ solenoid valve has failed when the situation where the oil pressure does not decrease by the predetermined reference pressure or more than the predetermined reference pressure and the PWM duty deviates from the predetermined average duty by the predetermined reference duty or more the predetermined reference duty repeats itself a predetermined reference number of times or more than the predetermined reference number of times.

When the oil pressure decreases by the predetermined reference pressure or more than the predetermined reference pressure or the PWM duty does not deviate from the predetermined average duty by the predetermined reference duty or more, the counter for comparison with the reference number of repetitions may be reset.

Determining whether a driving cycle of a vehicle is equal to or greater than a predetermined driving cycle is further included, wherein the failure of the PCJ solenoid valve may be diagnosed when the driving cycle exceeds the predetermined reference driving cycle; and the average of the PWM duties of the driving cycle up to this may be determined to obtain the predetermined average duty without diagnosing the failure of the PCJ solenoid valve when the driving cycle does not exceed the predetermined reference driving cycle.

The predetermined average duty may be updated with the average of the PWM duties of as many as a number of previous driving cycles corresponding to the predetermined reference driving cycle from among the latest PWM duties when the PWM duty does not deviate from the predetermined average duty by the predetermined reference duty or more than the predetermined reference duty.

The present disclosure enables the diagnosis of a failure of the PCJ solenoid valve without using the OPS, facilitating the diagnosis of the failure of the PCJ solenoid valve even when the mounting space for the OPS is not readily secured and reducing the manufacturing cost of the engine system.

The methods and apparatuses of the present disclosure have other features and advantages which will be apparent from or are set forth in more detail in the accompanying drawings, which are incorporated herein, and the following Detailed Description, which together serve to explain certain principles of the present disclosure.

Figure 1:
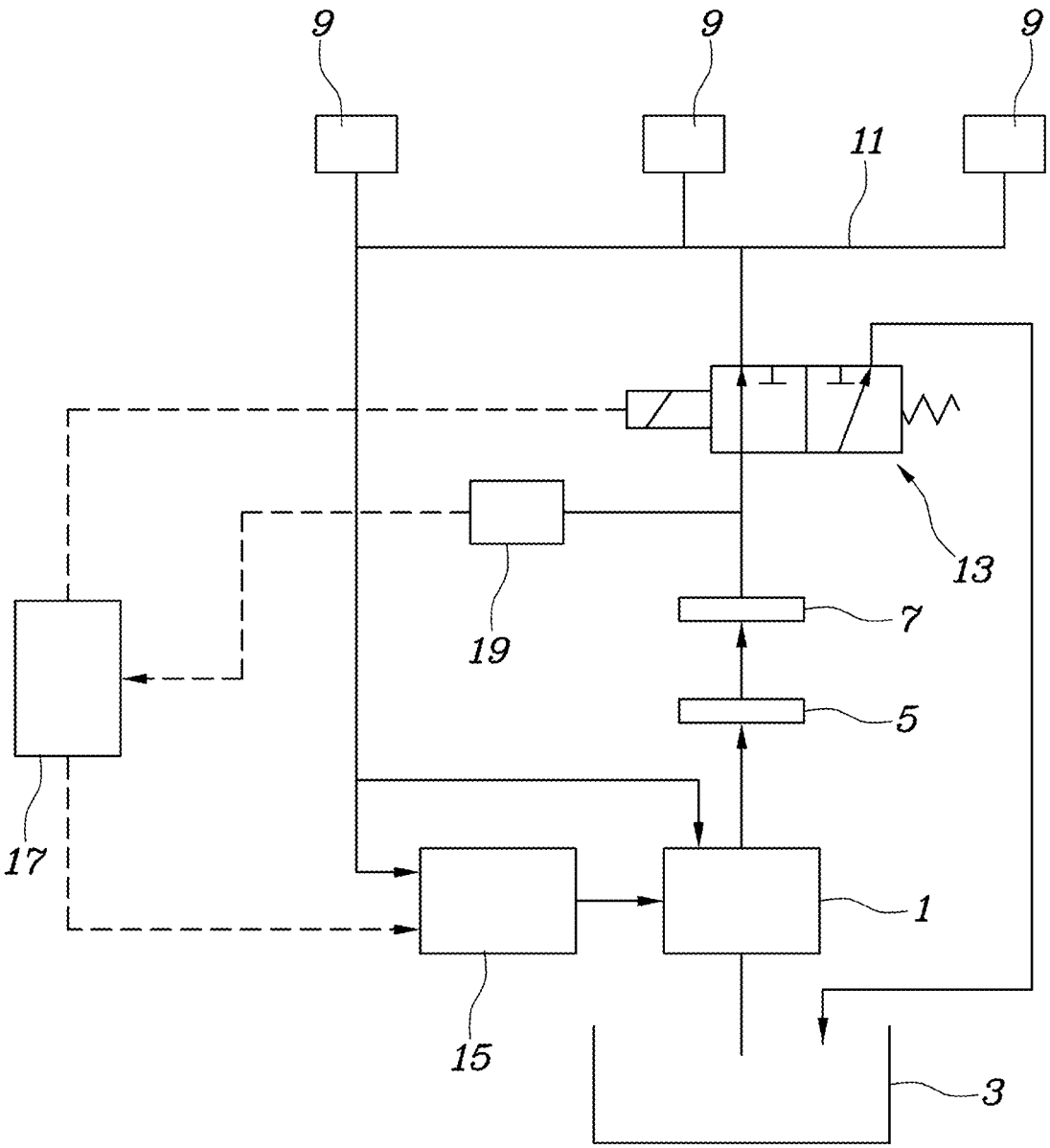
FIG. 1 is a view showing a PCJ oil pressure circuit to which the present disclosure may be applied.

It may be understood that the appended drawings are not necessarily to scale, presenting a somewhat simplified representation of various features illustrative of the basic principles of the present disclosure. The specific design features of the present disclosure as included herein, including, for example, specific dimensions, orientations, locations, and shapes will be determined in part by the particularly intended application and use environment.

In the figures, reference numbers refer to the same or equivalent parts of the present disclosure throughout the several figures of the drawing.

DETAILED DESCRIPTION

Reference will now be made in detail to various embodiments of the present disclosure(s), examples of which are illustrated in the accompanying drawings and described below. While the present disclosure(s) will be described in conjunction with exemplary embodiments of the present disclosure, it will be understood that the present description is not intended to limit the present disclosure(s) to those exemplary embodiments of the present disclosure. On the other hand, the present disclosure(s) is/are intended to cover not only the exemplary embodiments of the present disclosure, but also various alternatives, modifications, equivalents and other embodiments, which may be included within the spirit and scope of the present disclosure as defined by the appended claims.

Specific structural or functional descriptions of the exemplary embodiments of the present disclosure included in the exemplary embodiment or application are presented by way of examples only for describing the exemplary embodiments according to an exemplary embodiment of the present disclosure, and the exemplary embodiments according to an exemplary embodiment of the present disclosure may be implemented in various forms and should not be construed as being limited to the exemplary embodiments described in the exemplary embodiment or application.

Because the exemplary embodiment of the present disclosure may be modified in various ways and have various forms, predetermined embodiments will be illustrated in the drawings and described in the exemplary embodiment or application. However, this is not intended to limit the exemplary embodiments according to the concept of the present disclosure to the specific forms and should be construed as including all modifications, equivalents, and substitutes included in the spirit and technical scope of the present disclosure.

Terms such as first and/or second may be used to describe various components, but the components should not be limited by the terms. The terms only serve the purpose of distinguishing one component from other components. For example, the first component may be referred to as the second component, and similarly, the second component may also be referred to as the first component without deviating from the scope of the right according to the concept of the present disclosure.

When a component is referred to as being "connected" or "coupled" to another component, it may be directly connected or coupled to the another component, but it should be understood that other components may exist in between. On the other hand, when a component is referred to as being "directly connected" or "directly coupled" to another component, it should be understood that there are no intervening components present. Other expressions describing the relationship between components such as "between" and "just between", or "adjacent to" and "directly adjacent to" should be interpreted in the same manner.

The terms used herein are used for describing various exemplary embodiments only and are not intended to limit the present disclosure. Singular expressions include plural expressions unless the context explicitly indicates otherwise. In the exemplary embodiment, terms such as "comprise" or "have" are intended to designate the presence of implemented features, numbers, steps, operations, components, parts, or combinations thereof and should not be understood to preclude the presence or additional possibilities of one or more of other features, numbers, steps, operations, components, parts or combinations thereof in advance.

Unless otherwise defined, all terms used herein, including technical or scientific terms, have the same meanings as are generally understood by those with common knowledge in the art to which an exemplary embodiment of the present disclosure pertains. It will be further understood that terms, such as those defined in commonly used dictionaries, should be interpreted as having a meaning which is consistent with their meaning in the context of the exemplary embodiment, and will not be interpreted in an idealized or overly formal sense unless expressly so defined herein.

In the following, the present disclosure will be described in detail by describing exemplary embodiments of the present disclosure with reference to the accompanying drawings.

FIG. 1 exemplifies a PCJ hydraulic circuit to which the present disclosure may be applied. An oil pump 1 pumps the oil of an oil pan 3, and the oil pumped by the oil pump 1 is supplied through an oil cooler 5 and an oil filter 7 to a main gallery 11 to which PCJs 9 are connected.

The oil supplied to the main gallery 11 is controlled by a PCJ solenoid valve 13 and a pumping oil pressure in the oil pump 1 is controlled by an oil control valve 15.

The PCJ solenoid valve 13 and the oil control valve 15 are controlled by a controller 17, and the controller 17 receives a signal of oil pressure temperature detector (OPTS) 19 that measures the temperature and pressure of the oil supplied to the main gallery 11 to be configured to control the PCJ solenoid valve 13 and the oil control valve 15.

Here, the controller 17 controls the oil control valve 15 by a PWM duty to ultimately control the oil pump 1.

A method of diagnosing the PCJ solenoid valve according to an exemplary embodiment of the present disclosure will be performed by the controller 17 in the following.

Figure 2:
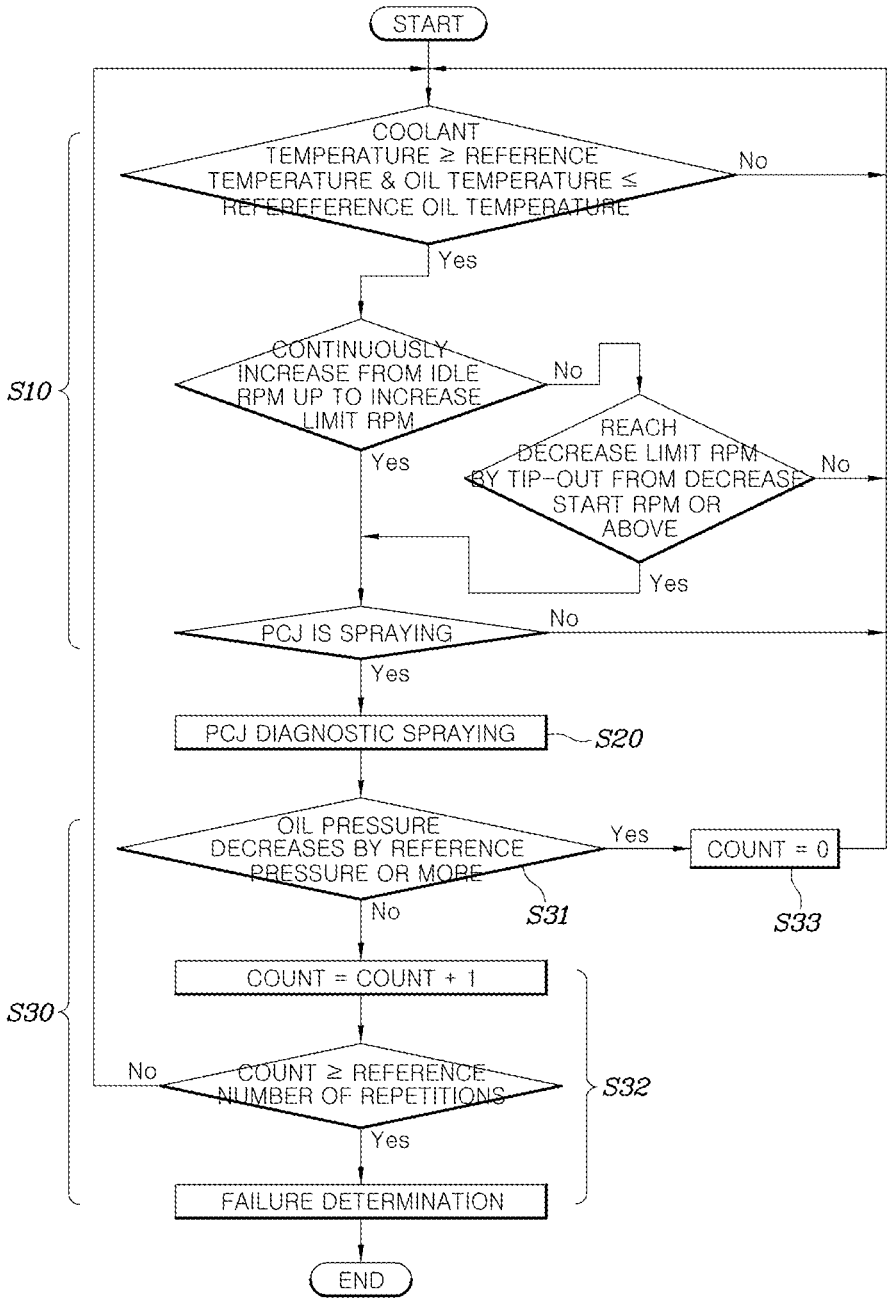
FIG. 2 is a flowchart of a PCJ solenoid valve diagnostic method according to various exemplary embodiments of the present disclosure.
Figure 3:
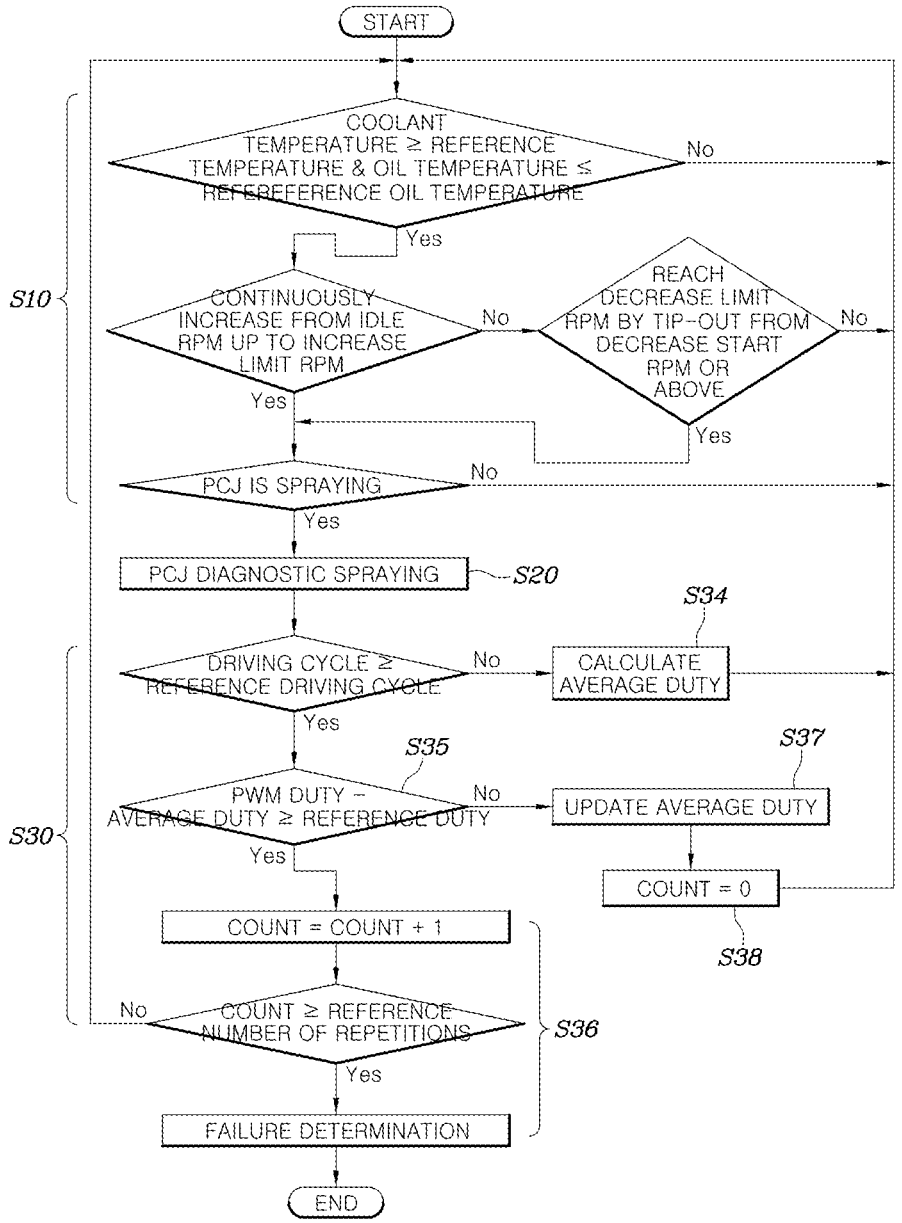
FIG. 3 is a flowchart of a PCJ solenoid valve diagnostic method according to various exemplary embodiments of the present disclosure.
Figure 4:
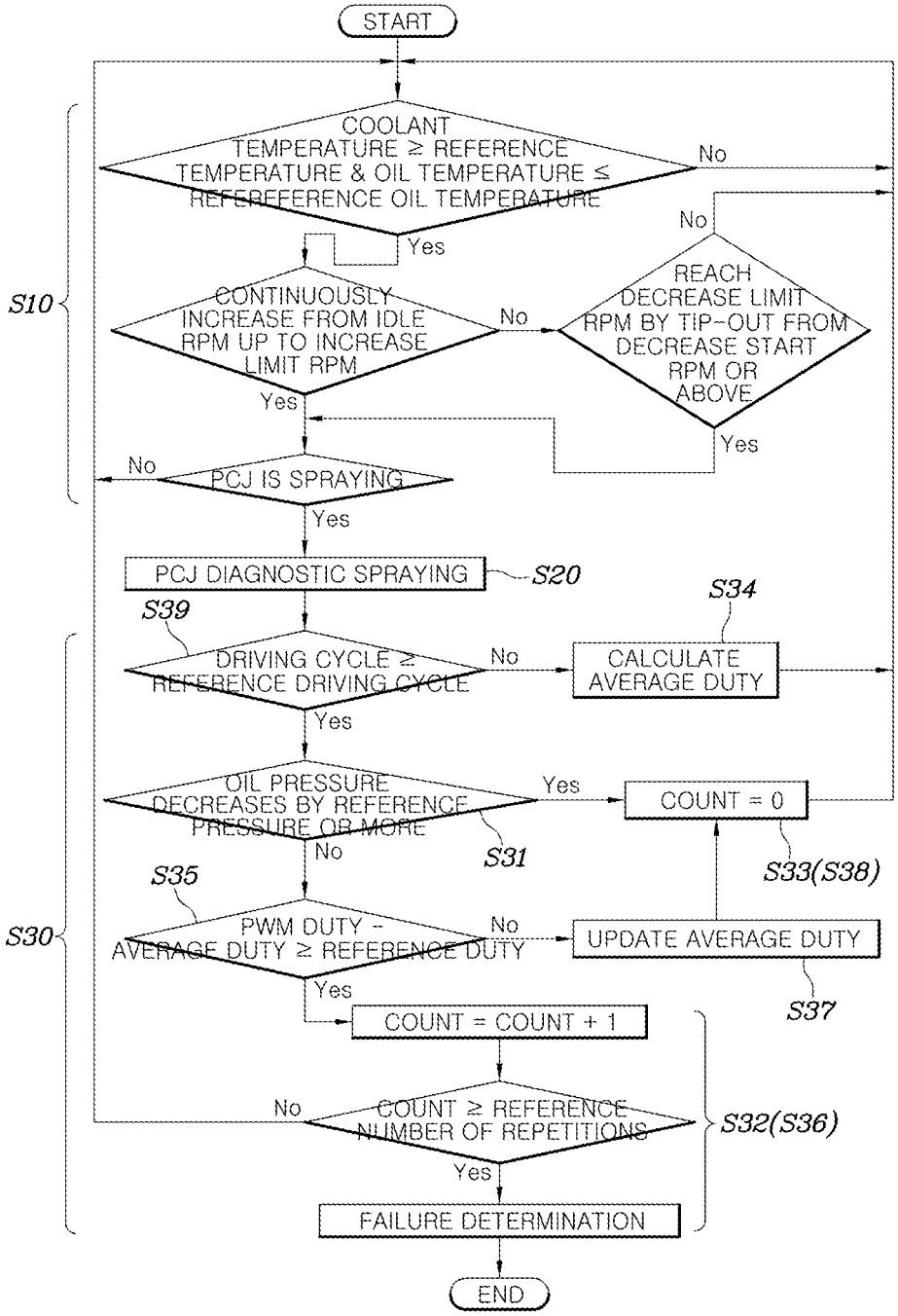
FIG. 4 is a flowchart of a PCJ solenoid valve diagnostic method according to various exemplary embodiments of the present disclosure.

The methods of diagnosing the PCJ solenoid valve according to various exemplary embodiments of the present disclosure in FIG. 2, FIG. 3 and FIG. 4 similarly include determining whether a predetermined diagnostic condition is satisfied (S10); performing diagnostic spraying by controlling the PCJ solenoid valve to cause the PCJ to spray oil for a predetermined diagnostic spraying time when the diagnostic condition is satisfied (S20); and diagnosing a failure of the PCJ solenoid valve by use of changes of oil pressure introduced to the PCJ or of the PWM duty that controls an oil pump 1 pumping the oil supplied to the PCJ after the diagnostic spraying by the PCJ (S30).

That is, according to an exemplary embodiment of the present disclosure, when the diagnostic condition is satisfied, the PCJ performs the diagnostic spraying, and the failure of the PCJ solenoid valve is diagnosed by use of the subsequent changes of the oil pressure and the changes of the PWM duty.

Accordingly, the OPS for diagnosing the failure of the PCJ solenoid valve is not separately required so that the failure of the PCJ solenoid valve may be diagnosed even when the mounting space for the OPS is not readily secured and the manufacturing cost of the engine system may be reduced.

The diagnostic condition is premised on a situation where the coolant temperature is equal to or greater than a predetermined reference coolant temperature, the oil temperature is equal to or lower than a predetermined reference oil temperature, and the PCJ is not spraying the oil.

That is, this is to check whether the engine coolant temperature is equal to or greater than the reference coolant temperature to ensure that the engine is sufficiently warmed upwards.

This is to ensure that the PCJ control as described below is not affected by the diagnosis of the PCJ solenoid valve because harmful exhaust substances should be reduced as much as possible by the precise control of the PCJ when the engine is started or when the engine is running cold.

Accordingly, the reference coolant temperature may be appropriately set through a number of experiments and analyses to serve the purpose as described above, to 80° C. for example.

Furthermore, this is to check whether the oil temperature is equal to or lower than the reference oil temperature and whether the viscosity of the oil is appropriate to ensure that the measured oil pressure is not excessively low.

Accordingly, the reference oil temperature may be appropriately set through a number of experiments and analyses to serve the purpose described above, to 105° C. for example.

Furthermore, that the PCJ is not spraying oil is included in the diagnostic condition, so that the diagnostic spraying by the PCJ as described above may avoid overlapping with the existing PCJ oil spraying and that the changes in oil pressure or PWM duty caused by the diagnostic spraying by the PCJ may be more accurately detected.

Furthermore, on the premise of the above conditions, the diagnostic condition is satisfied when the engine RPM continuously increases without deceleration from the idle RPM up to a predetermined increase limit RPM or when the engine RPM reaches a decrease predetermined limit RPM by a tip-out from a predetermined decrease start RPM or more than the predetermined decrease start RPM.

When the engine RPM continuously increases without deceleration from the idle RPM up to the increase limit RPM, the oil pressure measured by the OPTS should increase along with the increase of the engine RPM or remain constant by the PWM duty control of the oil control valve 15. When the diagnostic spraying by the PCJ as described above is done under such a circumstance, the oil pressure measured by the OPTS should decrease by the instantaneous use of the oil.

Accordingly, when the oil pressure measured by the OPTS does not decrease by a predetermined level or more despite the diagnostic spraying by the PCJ under the circumstance as described above, the PCJ solenoid valve may be determined to have failed.

Here, the idle RPM is normally 600-800 RPM, and the increase limit RPM may be set to 1500 RPM for example.

Furthermore, when the engine RPM reaches the predetermined decrease limit RPM from the predetermined decrease start RPM or above by a tip-out in which a driver releases the accelerator pedal, the vehicle does not drive on its power and the diagnostic spraying by the PCJ may be performed with almost no effect, if any, on the engine combustion. Even in the instant case, the oil pressure measured by the OPTS should remain constant so that the failure of the PCJ solenoid valve may be diagnosed while the oil pressure measured by the OPTS is monitored through the diagnostic spraying by the PCJ.

Accordingly, the decrease start RPM may be set to 2000 RPM for example, and the decrease limit RPM may be set to 1500 RPM for example.

Here, the diagnostic spraying time by the PCJ is set as short as possible as long as the changes of the oil pressure introduced to the PCJ or the changes of the PWM duty that controls the oil pump 1 may be reliably detected, to desirably avoid overlapping or interfering with the existing PCJ spraying control. The diagnostic spraying time by the PCJ may be set to 0.5 seconds for example.

FIG. 2 shows that, in the PCJ solenoid valve diagnostic method according to various exemplary embodiments of the present disclosure, the diagnosing the failure of the PCJ solenoid valve (S30) includes determining whether the oil pressure introduced to the PCJ decreases by a predetermined reference pressure or more after the diagnostic spraying by the PCJ (S31); and determining that the PCJ solenoid valve has failed when the situation where the oil pressure does not decrease by the reference pressure or more repeats itself a predetermined reference number of times or more (S32).

That is, when the diagnostic condition as described above is satisfied, the PCJ solenoid valve that performed the diagnostic spraying by the PCJ is considered to be normally operating when the oil pressure instantly decreases by a certain level or more upon the diagnostic spraying by the PCJ. When the situation where the oil pressure does not decrease by the reference pressure or more repeats itself a reference number of times or more, the PCJ solenoid valve may be determined to have failed.

Accordingly, the reference pressure may be set through a number of experiments and analyses to enable such determination as described above and may be set to 0.3 Bar for example.

Furthermore, the reference number of repetitions may be desirably set so that the number is large to draw a reliable diagnostic conclusion to a certain extent but small to ensure an early diagnosis of the failure of the PCJ solenoid valve so that the failed PCJ solenoid valve is not left unattended for too long. The reference number of repetitions may be set to three, for example.

On the other hand, when the oil pressure decreases by the reference pressure or more, the counter for comparison with the reference number of repetitions may be reset (S33).

That is, when the situation where the oil pressure does not decrease by the reference pressure or more at the time of the diagnostic spraying by the PCJ repeats itself less than the reference number of times, twice for example, cumulatively, the PCJ solenoid valve is considered to be normally operating when the oil pressure decreases by the reference pressure or more at the time of PCJ diagnostic spraying so that the cumulative count is reset to zero, enhancing the reliability of the diagnosis of the PCJ solenoid valve failure.

FIG. 3 shows that, in the PCJ solenoid valve diagnostic method according to various exemplary embodiments of the present disclosure, the diagnosing the failure of the PCJ solenoid valve (S30) includes determining whether the PWM duty that controls the oil pump 1 pumping the oil supplied to the PCJ deviates from the predetermined average duty by the predetermined reference duty or more than the predetermined reference duty after the diagnostic spraying by the PCJ (S35); and determining that the PCJ solenoid valve has failed when the situation where the PWM duty deviates from the average duty by the reference duty or more repeats itself a predetermined reference number of times or more (S36).

Here, the average duty is the average of the PWM duties by which the controller 17 commands the oil control valve 15 at the time of the diagnostic spraying by the PCJ. For example, the average of the PWM duties in the latest five driving cycles after the diagnostic spraying by the PCJ may be determined to obtain the average duty every time the driving cycle of the vehicle is repeated.

Accordingly, the average duty may be determined without performing further steps beyond determining whether the PWM duty deviates from the average duty by the reference duty or more in the driving cycles, equal to or less than the predetermined reference driving cycle, for determining the average duty (S34).

Here, the reference driving cycle may be set to five so that the average of the PWM duty subsequent to the diagnostic spraying by the PCJ in the latest five driving cycles may be determined to obtain the average duty.

As described above, when such diagnostic condition as described above is satisfied, a decrease of the oil pressure as described above is detected or the oil pressure remains constant by the early control of the controller 17 and oil control valve 15 upon the diagnostic spraying by the PCJ when the PCJ solenoid valve is normal. However, for this, the PWM duty by which the controller 17 commands the oil control valve 15 should increase by a certain level or more and the magnitude of the increase of the PWM duty will always remain at a constant level when the PCJ solenoid valve is normal so that comparison between the obtained average duty and the current PWM duty enables the diagnosis of the failure of the PCJ solenoid valve.

That is, when the difference between the current PWM duty and the average duty is greater than the reference duty, the present PWM duty may be deemed to significantly deviate from the average by the failed PCJ solenoid valve.

Accordingly, the reference duty may be set through a number of experiments and analyses to serve the purpose described above so that the PWM duty when the PCJ solenoid valve has failed and the average duty determined when the PCJ solenoid valve is normal may be differentiated from each other. The reference duty may be set to 10% for example.

When the PWM duty does not deviate from the average duty by the reference duty or more, the average duty is updated with an average of the PWM duties, including the PWM duty, of driving cycles corresponding to the latest reference driving cycle (S37).

That is, when the PWM duty does not deviate from the average duty by the reference duty or more so that the PCJ solenoid valve is determined to be normal, the current PWM duty is used in the determination of the average duty so that the average duty always reflects the latest hydraulic circuit status.

Furthermore, when the PWM duty does not deviate from the average duty by the reference duty or more, the counter for comparison with the reference number of repetitions may be reset.

Accordingly, when an error in the PWM duty increases the counter incidentally and a repeat diagnostic spraying by the PCJ returns the PWM duty close to the average duty so that the PCJ solenoid valve may be determined to be normal, the counter is reset to zero to prevent an erroneous diagnosis, enhancing the diagnosis reliability.

FIG. 4 shows that, in the PCJ solenoid valve diagnostic method according to various exemplary embodiments of the present disclosure, the diagnosing the failure of the PCJ solenoid valve includes determining whether the oil pressure introduced to the PCJ decreases by the predetermined reference pressure or more the predetermined reference pressure after the diagnostic spraying by the PCJ (S31); determining whether the PWM duty that controls the oil pump 1 pumping the oil supplied to the PCJ deviates from the predetermined average duty by the predetermined reference duty or more than the predetermined reference duty after the diagnostic spraying by the PCJ (S32); and determining that the PCJ solenoid valve has failed when the situation where the oil pressure does not decrease by the reference pressure or more than the reference pressure and the PWM duty deviates from the average duty by the reference duty or more repeats itself a predetermined reference number of times or more (S35).

That is, the various exemplary embodiments and the various exemplary embodiments are merged on an AND condition.

Furthermore, in an exemplary embodiment of the present disclosure, the counter for comparison with the reference number of repetitions is reset when the oil pressure decreases by the reference pressure or more than the reference pressure or the PWM duty does not deviate from the average duty by the reference duty or more (S33).

Furthermore, the exemplary embodiment further includes determining whether the driving cycle of the vehicle is equal to or greater than the predetermined reference driving cycle (S39), and the failure of the PCJ solenoid valve is diagnosed when the driving cycle is greater than the reference driving cycle (S30).

When the driving cycle does not exceed the reference driving cycle, the average of the PWM duties of the driving cycle up to this may be determined to obtain the average duty (S34) without diagnosing the failure of the PCJ solenoid valve (S30).

Furthermore, when the PWM duty does not deviate from the average duty by the reference duty or more, the average duty may be updated with the average of the PWM duties of as many as a number of previous driving cycles corresponding to the reference driving cycle from among the latest PWM duty (S37).

It should be noted that the steps in FIG. 4 which may be understood as substantially the same as the steps in FIGS. 2 and 3 are denoted by the same reference numerals for the sake of consistency.

Furthermore, the term related to a control device such as "controller", "control apparatus", "control unit", "control device" or "control module", etc refers to a hardware device including a memory and a processor configured to execute one or more steps interpreted as an algorithm structure. The memory stores algorithm steps, and the processor executes the algorithm steps to perform one or more processes of a method in accordance with various exemplary embodiments of the present disclosure. The control device according to exemplary embodiments of the present disclosure may be implemented through a nonvolatile memory configured to store algorithms for controlling operation of various components of a vehicle or data about software commands for executing the algorithms, and a processor configured to perform operation to be described above using the data stored in the memory. The memory and the processor may be individual chips. Alternatively, the memory and the processor may be integrated in a single chip. The processor may be implemented as one or more processors. The processor may include various logic circuits and operation circuits, may process data according to a program provided from the memory, and may generate a control signal according to the processing result.

The control device may be at least one microprocessor operated by a predetermined program which may include a series of commands for carrying out the method disclosed in the aforementioned various exemplary embodiments of the present disclosure.

The aforementioned invention can also be embodied as computer readable codes on a computer readable recording medium. The computer readable recording medium is any data storage device that can store data which may be thereafter read by a computer system and store and execute program instructions which may be thereafter read by a computer system. Examples of the computer readable recording medium include Hard Disk Drive (HDD), solid state disk (SSD), silicon disk drive (SDD), read-only memory (ROM), random-access memory (RAM), CD-ROMs, magnetic tapes, floppy discs, optical data storage devices, etc and implementation as carrier waves (e.g., transmission over the Internet). Examples of the program instruction include machine language code such as those generated by a compiler, as well as high-level language code which may be executed by a computer using an interpreter or the like.

In various exemplary embodiments of the present disclosure, each operation described above may be performed by a control device, and the control device may be configured by multiple control devices, or an integrated single control device.

In various exemplary embodiments of the present disclosure, the control device may be implemented in a form of hardware or software, or may be implemented in a combination of hardware and software.

Furthermore, the terms such as "unit", "module", etc. Included in the specification mean units for processing at least one function or operation, which may be implemented by hardware, software, or a combination thereof.

For convenience in explanation and accurate definition in the appended claims, the terms "upper", "lower", "inner", "outer", "up", "down", "upwards", "downwards", "front", "rear", "back", "inside", "outside", "inwardly", "outwardly", "interior", "exterior", "internal", "external", "forwards", and "backwards" are used to describe features of the exemplary embodiments with reference to the positions of such features as displayed in the figures. It will be further understood that the term "connect" or its derivatives refer both to direct and indirect connection.

The foregoing descriptions of specific exemplary embodiments of the present disclosure have been presented for purposes of illustration and description. They are not intended to be exhaustive or to limit the present disclosure to the precise forms disclosed, and obviously many modifications and variations are possible in light of the above teachings. The exemplary embodiments were chosen and described to explain certain principles of the present disclosure and their practical application, to enable others skilled in the art to make and utilize various exemplary embodiments of the present disclosure, as well as various alternatives and modifications thereof. It is intended that the scope of the present disclosure be defined by the Claims appended hereto and their equivalents.

What is claimed is:

1. A method of diagnosing a piston cooling jet solenoid valve of a piston cooling jet (PCJ), the method comprising:

determining, by a controller, whether a predetermined diagnostic condition is satisfied;

performing, by the controller, diagnostic spraying by controlling the PCJ solenoid valve to cause the PCJ to spray oil for a predetermined diagnostic spraying time when the controller concludes that the predetermined diagnostic condition is satisfied; and diagnosing, by the controller, a failure of the PCJ solenoid valve by use of changes of oil pressure introduced to the PCJ or of pulse-width modulation (PWM) duty that controls an oil pump configured for pumping oil supplied to the PCJ after the diagnostic spraying by the PCJ.

2. The method of claim 1, wherein the predetermined diagnostic condition includes a situation in which coolant temperature is equal to or greater than a predetermined reference coolant temperature, oil temperature is equal to or lower than a predetermined reference oil temperature, and the PCJ is not spraying the oil.

3. The method of claim 2, wherein the predetermined diagnostic condition further includes either an engine revolutions per minute (RPM) continuously increasing without deceleration from an idle RPM up to a predetermined increase limit RPM or the engine RPM reaching a predetermined decrease limit RPM by a tip-out from a predetermined decrease start RPM or more than the predetermined decrease start RPM.

4. The method of claim 3, wherein the diagnosing the failure of the PCJ solenoid valve includes:

determining whether the oil pressure introduced to the PCJ decreases by a predetermined reference pressure or more than the predetermined reference pressure after the diagnostic spraying by the PCJ; and determining that the PCJ solenoid valve has failed when a situation where the oil pressure does not decrease by the predetermined reference pressure or more than the predetermined reference pressure repeats itself a predetermined reference number of times or more than the predetermined reference number of times.

5. The method of claim 4, wherein a counter for comparison with the reference number of repetitions is reset when the oil pressure decreases by the predetermined reference pressure or more than the predetermined reference pressure.

6. The method of claim 3, wherein the diagnosing the failure of the PCJ solenoid valve includes:

determining whether the PWM duty that controls the oil pump configured for pumping the oil supplied to the PCJ deviates from a predetermined average duty by a predetermined reference duty or more the predetermined reference duty after the diagnostic spraying by the PCJ; and determining that the PCJ solenoid valve has failed when a situation where the PWM duty deviates from the predetermined average duty by the predetermined reference duty or more the predetermined reference duty repeats itself a predetermined reference number of times.

7. The method of claim 6, wherein a counter for comparison with the reference number of repetitions is reset when the PWM duty does not deviate from the predetermined average duty by the predetermined reference duty or more than the predetermined reference duty.

8. The method of claim 6, wherein the predetermined average duty is determined without performing further steps beyond determining whether the PWM duty deviates from the predetermined average duty by the predetermined reference duty or more than the predetermined reference duty in a driving cycle, equal to or less than a predetermined driving cycle, for determining the average duty.

9. The method of claim 8, wherein an average of PWM duties, including the PWM duty, of driving cycles corresponding to a latest reference driving cycle is determined to update the predetermined average duty when the PWM duty does not deviate from the predetermined average duty by the predetermined reference duty or more than the predetermined reference duty.

10. The method of claim 3, wherein the diagnosing the failure of the PCJ solenoid valve includes:

determining whether the oil pressure introduced to the PCJ decreases by a predetermined reference pressure or more the predetermined reference pressure after the diagnostic spraying by the PCJ;

determining whether the PWM duty that controls the oil pump configured for pumping the oil supplied to the PCJ deviates from a predetermined average duty by a predetermined reference duty or more than the predetermined reference duty after the diagnostic spraying by the PCJ; and determining that the PCJ solenoid valve has failed when a situation where the oil pressure does not decrease by the predetermined reference pressure or more than the predetermined reference pressure and the PWM duty deviates from the predetermined average duty by the predetermined reference duty or more the predetermined reference duty repeats itself a predetermined reference number of times or more than the predetermined reference number of times.

11. The method of claim 10, wherein a counter for comparison with the reference number of repetitions is reset when the oil pressure decreases by the predetermined reference pressure or more than the predetermined reference pressure or the PWM duty does not deviate from the predetermined average duty by the predetermined reference duty or more than the predetermined reference duty.

12. The method of claim 10 further including determining whether a driving cycle of a vehicle is equal to or greater than a predetermined reference driving cycle, wherein the failure of the PCJ solenoid valve is diagnosed when the driving cycle exceeds a reference driving cycle; and an average of PWM duties of driving cycles up to the predetermined reference driving cycle is determined to obtain the predetermined average duty without diagnosing the failure of the PCJ solenoid valve when the driving cycle does not exceed the predetermined reference driving cycle.

13. The method of claim 12, wherein the predetermined average duty is updated with the average of the PWM duties of as many as a number of previous driving cycles corresponding to the predetermined reference driving cycle from among the PWM duty when the PWM duty does not deviate from the predetermined average duty by the predetermined reference duty or more than the predetermined reference duty.

14. A system of diagnosing a piston cooling jet solenoid valve of a piston cooling jet (PCJ), the system comprising:

an oil pump configured for supplying oil to a main gallery to which the PCJ is connected;

the PCJ solenoid valve configured for controlling the oil supplied to the main gallery; and a controller configured for controlling the PCJ solenoid valve, wherein the controller is configured for:

determining whether a predetermined diagnostic condition is satisfied;

performing diagnostic spraying by controlling the PCJ solenoid valve to cause the PCJ to spray oil for a predetermined diagnostic spraying time when the controller concludes that the predetermined diagnostic condition is satisfied; and diagnosing a failure of the PCJ solenoid valve by use of changes of oil pressure introduced to the PCJ or of pulse-width modulation (PWM) duty that controls the oil pump configured for pumping the oil supplied to the PCJ after the diagnostic spraying by the PCJ.

15. The apparatus of claim 14, wherein the diagnosing the failure of the PCJ solenoid valve includes:

determining whether the oil pressure introduced to the PCJ decreases by a predetermined reference pressure or more than the predetermined reference pressure after the diagnostic spraying by the PCJ; and determining that the PCJ solenoid valve has failed when a situation where the oil pressure does not decrease by the predetermined reference pressure or more than the predetermined reference pressure repeats itself a predetermined reference number of times or more than the predetermined reference number of times.

16. The apparatus of claim 14, wherein the diagnosing the failure of the PCJ solenoid valve includes:

determining whether the PWM duty that controls the oil pump configured for pumping the oil supplied to the PCJ deviates from a predetermined average duty by a predetermined reference duty or more the predetermined reference duty after the diagnostic spraying by the PCJ; and determining that the PCJ solenoid valve has failed when a situation where the PWM duty deviates from the predetermined average duty by the predetermined reference duty or more the predetermined reference duty repeats itself a predetermined reference number of times.

17. The apparatus of claim 16, wherein the predetermined average duty is determined without performing further steps beyond determining whether the PWM duty deviates from the predetermined average duty by the predetermined reference duty or more than the predetermined reference duty in a driving cycle, equal to or less than a predetermined driving cycle, for determining the average duty.

18. The apparatus of claim 14, wherein the diagnosing the failure of the PCJ solenoid valve includes:

determining whether the oil pressure introduced to the PCJ decreases by a predetermined reference pressure or more the predetermined reference pressure after the diagnostic spraying by the PCJ;

determining whether the PWM duty that controls the oil pump configured for pumping the oil supplied to the PCJ deviates from a predetermined average duty by a predetermined reference duty or more than the predetermined reference duty after the diagnostic spraying by the PCJ; and determining that the PCJ solenoid valve has failed when a situation where the oil pressure does not decrease by the predetermined reference pressure or more than the predetermined reference pressure and the PWM duty deviates from the predetermined average duty by the predetermined reference duty or more the predetermined reference duty repeats itself a predetermined reference number of times or more than the predetermined reference number of times.

19. The apparatus of claim 18, wherein the controller is further configured for determining whether a driving cycle of a vehicle is equal to or greater than a predetermined reference driving cycle, wherein the failure of the PCJ solenoid valve is diagnosed when the driving cycle exceeds the predetermined reference driving cycle;

and an average of PWM duties of driving cycles up to the predetermined reference driving cycle is determined to obtain the predetermined average duty without diagnosing the failure of the PCJ solenoid valve when the driving cycle does not exceed the predetermined reference driving cycle.

20. The apparatus of claim 19, wherein the predetermined average duty is updated with the average of the PWM duties of as many as a number of previous driving cycles corresponding to the predetermined reference driving cycle from among the PWM duty when the PWM duty does not deviate from the predetermined average duty by the predetermined reference duty or more than the predetermined reference duty.

* * * * *